United States Patent [19]

Bornhofft et al.

[11] Patent Number: 4,562,789

[45] Date of Patent: Jan. 7, 1986

[54] ARRANGEMENT FOR REMOTE SWEEPING OF MINES SENSITIVE TO MAGNETIC FIELDS

[75] Inventors: Wolfgang Bornhofft, Seevetal; Gerhard Irenkler, Braunschweig, both of Fed. Rep. of Germany

[73] Assignee: Thomson-CSF, Paris, France

[21] Appl. No.: 605,813

[22] Filed: May 1, 1984

[30] Foreign Application Priority Data

May 3, 1983 [DE] Fed. Rep. of Germany ..... 3316005

[51] Int. Cl.[4] ..... B63B 21/00

[52] U.S. Cl. ..... 114/312; 114/242; 114/221 R; 114/244; 114/337; 102/402

[58] Field of Search ..... 114/221 R, 244, 242, 114/313, 322, 330, 337, 312; 102/402, 417; 340/850–852; 180/79.1

[56] References Cited

U.S. PATENT DOCUMENTS

| | | | |
|---|---|---|---|
| 3,789,939 | 2/1974 | Geislinger | 180/79.1 |
| 3,826,215 | 7/1974 | Dyjack | 114/221 R |
| 3,939,753 | 2/1976 | Rosborough et al. | 102/402 |
| 3,946,696 | 3/1976 | Lubnow | 114/221 R |
| 4,220,108 | 9/1980 | Burt | 102/417 |

*Primary Examiner*—Trygve M. Blix
*Assistant Examiner*—Edwin L. Swinehart
*Attorney, Agent, or Firm*—Oblon, Fisher, Spivak, McClelland & Maier

[57] ABSTRACT

An arrangement for sweeping mines having firing systems which are sensitive to magnetic fields is disclosed which utilizes a remote control mobile floating body with a built-in propulsion system. A magnetic field is generated within a group of permanent magnets located within the floating body in such a manner that these permanent magnets are either individually controlled or controlled as a group so that various types of magnetic field mines can be detected.

5 Claims, 3 Drawing Figures

ARRANGEMENT FOR REMOTE SWEEPING OF MINES SENSITIVE TO MAGNETIC FIELDS

BACKGROUND OF THE INVENTION

FIELD OF THE INVENTION

The present invention relates to a device which provides mine sweeping operations for detecting mines having ignition system sensitive to the magnetic fields.

Sweep devices, in the form of towed live electrodes or cable loops of the double-wire circuit are used for remote sweeping of mines located beneath the surface of the sea.

The power supply for the sweep devices is by means of generators on board manned sweeper crafts connected to towed cables.

These crafts, which normally operate in formation, are used for sweeping magnetic and/or acoustic mines as described in German Patent Application DE-PS No. 20 14 623. The field winding of the generator is controlled by an electric signal transmitter for presetting a sweep program in the form of different types of signals via a servo component.

In one variation, rods are housed in mobile, directionable floats in which the sweep current generators are also located.

In this connection reference is made to the German Patent Application DE-PS No. 978 056 according to which the sweeper is in the form of a cylindrical pressure hull capable of floating which is encircled by windings having current passing therethrough. The pressure hull accommodates the power propulsion generator, the magnetic field and the sound waves.

One or more of these floats are remotely controlled by a manned mother-ship.

Each of these prior art devices produce the magnetic sweep field electromagnetically and in the case of high sweep performances there is a considerable consumption of power which greatly reduces the utilization time and consequently prevents a fast sweep of large areas. Furthermore, it is common to these devices that the far zone and, to a certain extent, the near zone can be considered as homogeneous at short distances. Thus these devices cannot be used to sweep mines with magnetic differential field or gradient ignition systems or else they would be destroyed if the mine in the near zone receives sufficiently high gradients as in the arrangement utilizing magnetizable rods.

SUMMARY OF THE INVENTION

According, it is an objective of the invention to create a device for remote sweeping of mines sensitive to magnetic fields, which is also suitable for remote sweeping of differential fields or gradient mines and which allows long periods of operation with minimum consumption of power.

In this type of sweeper, large sources of power are not needed, and thus the particular advantage of the solution according to the invention is that it entails low costs to produce the device and in particular all prior knowledge of manufacture and operation of torpedos can be utilized.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein:

The float (3) according to FIG. 1, which is similar in shape to a torpedo, has, in addition to the usual sonar and control section (4) and drive section 6, a sweep section 5 in which a series of disc-shaped permanent magnets 8 are found. As can be seen from FIG. 2, these are positioned to rotate around an axis 10 in a cylindrical hull 7 and can be turned in any angle position by a remote controlled motor with gear 9. FIG. 2*b* shows the magnetic disc 8 in the direction of magnetization.

For the setting up of a sweep field produced by a magnetic dipole, all magnetic discs 8 are tuned in such a way that the direction of the planar normal line conforms with the axis of the float and the direction of magnetization is equal. The sweep field produced in this way $H_{PD}$ is approximately $$H_{PD} = \sum_{1=i}^{n} - \text{degree}\left[-\tfrac{1}{4}\pi\left(\vec{m}\ \text{degree}_p \frac{1}{r_i}\right)\right]$$

$$\text{with } \vec{m} = M \cdot \pi \frac{a^2}{4} \cdot d \text{ for } r_i >> a,\ d$$

Figure 1:
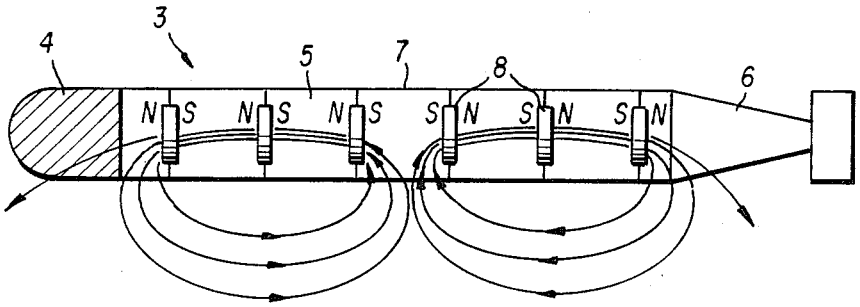
FIG. 1 shows a torpedo type sweeping vessel
Figure 2A:
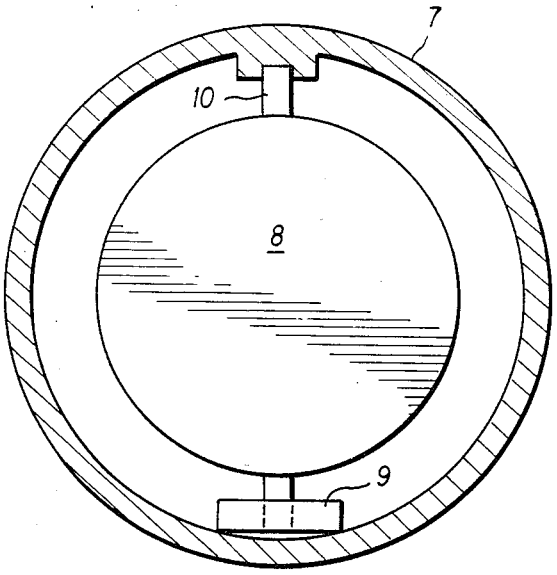
FIGS. 2*a* and 2*b* show two views of one of the permanent magnets used for generation of the field.
Figure 2B:
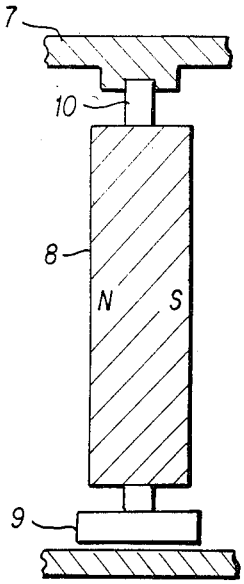

M is the magnetization of the magnetic disc, m the magnetic moment, r the distance to the top point, a the diameter and d the thickness of the disc. In order to obtain a stronger field gradient at greater distances, as for instance is necessary for sweeping of gradient mines, a double dipole field is produced by reversing the direction of half of the magnetic discs (see FIG. 1). The resulting magnetic field $H_{P\,r}$ is as follows $$H_{Pr} = \sum_{i=1}^{n} - \text{degree}\left[-\frac{1}{4\pi}\quad m\ \text{degree}_p \frac{1}{r_i}\right)\right] + \sum_{i=1}^{n1} - \text{degree}\left[\tfrac{1}{4}\left(-\vec{m}\ \text{degree}_p \frac{1}{r_i}\right)\right]$$

In the most general case, any arbitrary desired angle position of the magnetic disc can be set so that the magnetic field is not too close for estimation by the following formula:

$$H_p r = \sum_{i=1}^{n} - \text{degree}\left[-\tfrac{1}{4}\left(-m_i\ \text{degree}_P \frac{1}{r_i}\right)\right]$$

In order not to endanger the carrier in the transport of float 3, the magnetic discs 8 are turned with their planar normal lines perpendicular to the float axis whereby the magnetization direction alternately turns itself by 180°. A resulting field is then obtained which dampens very quickly with $$H_{Pr} \sim \frac{1}{(r3)}\ n$$

so that the field current remains negligably small even at short distances.

If particular sweep tasks require a time change in their course, then the magnetic disc angle can be altered in relation to the longitudinal axis of the float 3 by means of a suitable timed remote or programmed control.

Furthermore a sweep program can be input to the float 3 which runs automatically. At the end of the program, the float returns independently to a carrier craft.

Only materials with sufficiently high coercive field force can be used as magnetic material in order to prevent demagnetization when the magnetic discs are turned. Among the materials presently known, rare earth magnetic materials are particularly suitable. With regard to ferrites, the sweep distance is smaller due to the small magnetic saturation.

All systems known from torpedo technology can be used to drive the float 3 such as electric and diesel motors.

In particular, the float can be quipped with a three phase motor which is supplied via a three-phase cable from the carrier craft and float. This cable can contain also a wire or optical waveguide to transfer remote control signals.

In addition, for sweeping of acoustic sensitive mines, the float can contain or tow a sound producer, which gives off a frequency spectrum specific to the ship.

Furthermore, in the sonar and control unit 4, measuring devices for magnetic fields can be provided.

Obviously, numerous modifications and variations of the present invention are possible in light of the above teachings. It is therefore to be understood that within the scope of the appended claims, the invention may be practiced otherwise than as specifically described herein.

We claim:

1. A device for conducting mine sweeping operations for mines having ignition systems sensitive to magnetic fields, comprising:

a self-drive remote control float for surface or undersea operations;

a plurality of identical permanent magnets located in said float wherein each of said magnets are spaced apart from each other such that a main axis of each one of said magnets is parallel to the main axes of the others of said magnets and wherein said permanent magnets generate a magnetic field required for sweeping said mines;

a plurality of rotation means respectively associated with each of said plurality of magnets for rotating each of said magnets about their respective main axis; and control means for the controlling of said plurality of rotating means of said magnets whereby said control means provides for said rotation means to cause a predetermined amount of rotation of said magnets about said main axis in correspondence with respective different ignition systems of mines which are being swept and the extent of the area which is being swept.

2. The device according to claim 1, wherein said plurality of permanent magnets are disc-shaped magnets.

3. The device according to claim 1, wherein said control means includes a means for programmed remote control of the direction of the magnetic field produced by each of said permanent magnets.

4. The device according to claim 1, wherein said control means further includes a means for changing the direction of the field of each of said permanent magnets while said device is conducting a sweeping operation.

5. The device according to claim 3, wherein said control means includes a means for controlling said plurality of rotation means when said sweeping operation is not taking place so that the external magnetic field produced by said plurality of permanent magnets is minimal.

* * * * *